US008572794B2

(12) United States Patent
Pate

(10) Patent No.: US 8,572,794 B2
(45) Date of Patent: Nov. 5, 2013

(54) ORAL-CARE BRUSHING IMPLEMENT

(76) Inventor: Dilcia Yamileth Pate, Rogers, AR (US)

( * ) Notice: Subject to any disclaimer, the term of this patent is extended or adjusted under 35 U.S.C. 154(b) by 262 days.

(21) Appl. No.: 13/219,320

(22) Filed: Aug. 26, 2011

(65) Prior Publication Data

US 2012/0047669 A1 Mar. 1, 2012

Related U.S. Application Data

(60) Provisional application No. 61/377,748, filed on Aug. 27, 2010.

(51) Int. Cl.
*A46B 9/04* (2006.01)

(52) U.S. Cl.
USPC ..... 15/167.1; 15/22.1

(58) Field of Classification Search
USPC ..... 15/167.1, 22.1, 22.2; 300/21; D4/124, D4/125, 126, 104
See application file for complete search history.

(56) References Cited

U.S. PATENT DOCUMENTS

| | | | | |
|---|---|---|---|---|
| 2,360,745 | A | 10/1944 | Vogel | |
| 2,273,207 | A | 2/1972 | Kuhn | |
| 3,753,266 | A | 8/1973 | Ceniceros | |
| 4,356,585 | A | 11/1982 | Protell et al. | |
| 4,561,184 | A | 12/1985 | Fujitani | |
| 4,654,921 | A | 4/1987 | Dinner | |
| 5,048,143 | A | 9/1991 | Carroll | |
| 5,052,071 | A | 10/1991 | Halm | |
| 5,078,732 | A | 1/1992 | Ceniceros | |
| D324,455 | S | 3/1992 | Fasitta et al. | |
| 5,138,737 | A | 8/1992 | Thomas | |
| D366,961 | S | 2/1996 | Barre | |
| 5,511,273 | A | 4/1996 | Carroll | |
| 5,575,098 | A | 11/1996 | Goettel-Schwartz | |
| 5,623,739 | A | 4/1997 | Thompson | |
| D383,307 | S * | 9/1997 | Klein et al. | D4/105 |
| D401,069 | S | 11/1998 | Lamond et al. | |
| 5,926,898 | A * | 7/1999 | Kramer | 15/167.1 |
| D419,305 | S | 1/2000 | Porter et al. | |
| D428,704 | S | 8/2000 | Wildman | |
| 6,205,611 | B1 * | 3/2001 | Vigil | 15/244.1 |
| 6,427,265 | B1 | 8/2002 | Dix | |
| D497,482 | S | 10/2004 | Porter et al. | |
| D499,554 | S | 12/2004 | Ramelli | |
| 7,036,180 | B2 | 5/2006 | Hanlon | |
| 7,047,591 | B2 | 5/2006 | Hohlbein | |
| D531,414 | S | 11/2006 | Wong | |
| D531,809 | S | 11/2006 | Li | |
| 7,152,739 | B1 | 12/2006 | Burleson | |
| 7,174,596 | B2 | 2/2007 | Fischer et al. | |
| D579,207 | S | 10/2008 | Jamson | |
| 7,917,986 | B2 | 4/2011 | Jimenez et al. | |
| 7,988,742 | B2 | 8/2011 | Stein et al. | |
| 2003/0017874 | A1 | 1/2003 | Jianfei et al. | |
| 2003/0213075 | A1 * | 11/2003 | Hui et al. | 15/22.1 |
| 2005/0283932 | A1 | 12/2005 | Robbins | |

* cited by examiner

*Primary Examiner* — Shay Karls
(74) *Attorney, Agent, or Firm* — Hovey Williams LLP

(57) ABSTRACT

An oral-care brushing implement having a circumferential bristle arrangement secured to a cushioned surface head with an annular guard to facilitate effective, efficient, and safe use by a user with impaired dexterity and/or skill, and an ornamental appearance to incentivize use by the user.

16 Claims, 5 Drawing Sheets

ORAL-CARE BRUSHING IMPLEMENT

RELATED APPLICATION

The present application claims priority to U.S. provisional patent application No. 61/377,748 filed Aug. 27, 2010, which is hereby incorporated by reference in its entirety.

BACKGROUND

1. Field

Embodiments of the present invention relate to toothbrushes designed to more thoroughly clean teeth and gums and to encourage regular use by children.

2. Discussion of Prior Art

Toothbrushes should ideally be used several times per day to clean users' teeth and gums, and remove plaque and help prevent tooth decay and gum disease that may result from foreign debris on the teeth. Conventional toothbrushes consist of a head mounted to a handle with tightly-clustered bristles extending from the head. The bristles of such conventional toothbrushes are typically identical to each other and configured to extend from the head in a common direction.

To maximize benefits of toothbrush use, proper use of the toothbrush is necessary. It is generally desirable to slide the bristles several times over side and end surfaces of the teeth as well as the gums of the user. Because teeth may be missed during use of the toothbrush, for instance because some teeth are difficult to reach, proper use requires a degree of manual dexterity and skill that may prevent some users from properly using the toothbrush. For instance, it may be difficult or impossible for users with impaired dexterity, such as children and handicapped users, to properly use a conventional toothbrush.

Often times, foreign debris on the teeth is microscopic and benefits yielded from properly using the toothbrush may not be readily apparent to the user. Thus, a degree of motivation is generally required to incentivize consistent and proper toothbrush use. Most adult users are generally aware of the intrinsic benefits yielded from proper toothbrush use and therefore do not require motivation. Younger users, however, may not be aware or fully understand the benefits of consistent and proper toothbrush use and, as a result, may neglect to use a toothbrush properly or may decline to use the toothbrush altogether.

Accordingly, there is a need for a toothbrush that facilitates effective, efficient, and safe use by a user with impaired dexterity and/or skill, and provides motivation for use by younger users.

SUMMARY

The following brief summary is provided to indicate the nature of the subject matter disclosed herein. While certain aspects of the present invention are described below, the summary is not intended to limit the scope of the present invention. Embodiments of the present invention provide an oral-care brushing implement and method of manufacture that does not suffer from the problems and limitations of conventional toothbrushes such as those set forth above.

The present invention provides, in its simplest form, a toothbrush having a circumferential bristle arrangement secured to a cushioned surface head with an annular guard to facilitate effective, efficient, and safe use by a user with impaired dexterity and/or skill, and an ornamental appearance to incentivize use by the user.

The aforementioned aspects may be achieved in one aspect of the present invention by providing an oral-care brushing implement including a handle having a gripping region and a head assembly secured at an end of the handle. The head assembly may have an intermediary region and a brushing region. The implement may further include an ornamental region extending along the handle and the head assembly. The ornamental region may define a three-dimensional sculpture.

The implement may include a plurality of bristles radiating from a top of the head assembly to define an uppermost portion of the three-dimensional sculpture. The three-dimensional sculpture is shaped to resemble a character. The character may have an anatomical shape, such as a humanoid or animal shape with a torso defining the gripping region. The uppermost portion of the three-dimensional sculpture may define the brushing region and the intermediary region may space the gripping region and the brushing region. The torso may include shoulders on an end of the torso adjacent to the intermediary region and a stand on another end of the torso opposite to the shoulders. The stand may be operable to support the three-dimensional sculpture in an upright position. The plurality of bristles may define an outermost surface of the uppermost portion of the three-dimensional sculpture. The handle may define an outermost surface of a lowermost portion of the three-dimensional sculpture. The handle may have flared ends with a concave region between the flared ends to facilitate gripping of the gripping region portion of the handle. The plurality of bristles may be of varying lengths with a longest of the plurality of bristles defining a uniform outermost surface of the head assembly.

The head assembly may include an elongated base to support at least a portion of the plurality of bristles in a 360 degree configuration, the elongated base extending parallel to the handle. The head assembly may also include a base having a substantially compressible outer region and a substantially non-compressible inner region. The head assembly may also include a base having flared sections with concavities between the flared sections. The flared sections and concavities of the base may support the portion of the plurality of bristles in a convergent configuration to define a channel operable to receive and partially surround an object to be brushed. The channel may extend parallel and/or perpendicular to the base. The implement may further include a guard between the top and the handle, the guard having a hand-abutment lower surface and a face-abutment upper surface.

The aforementioned aspects may be achieved in one aspect of the present invention by providing an oral-care brushing implement having an ornamental outer surface that resembles a character. The implement may include a handle having a gripping region and a head assembly including an extension and a top. The head assembly may be secured at an end of the handle. The implement may further include a plurality of tufts each including a plurality of bristles. The plurality of tufts may extend substantially about the top in a circumferential configuration. The implement may further include a hand guard secured between the handle and the head assembly. The hand guard may partially enclose the handle. The hand guard may have a hand-abutment lower surface and a face-abutment upper surface. The extension may space the top from the handle. The top may include a support rod secured at an end of the extension and a circumferential cushion mounted to the support rod.

The aforementioned aspects may be achieved in one aspect of the present invention by providing a method of manufacturing an oral-care brushing implement to resemble a character. The method may include the steps of forming a handle to provide a gripping region and resemble a lower portion of the character and forming a top with a plurality of bristles to provide a brushing region and resemble an upper portion of the character. The method may further include the steps of forming a connector to provide an ornamental intermediary region between the handle and the top and resemble a middle portion of the character and assembling the handle, the top, and the head to form a three-dimensional sculpture of the character.

The connector may include ornamental facial features and may be configured to cooperate with the handle and the top so that the three-dimensional sculpture resembles a humanoid or has an anatomical appearance. The ornamental facial features may resemble eyes, a nose, a mouth, and/or ears. The handle may include (i) shoulders on an end of the handle adjacent to the connector, and (ii) a stand on another end of the handle opposite to the shoulders. The stand may be operable to support the three-dimensional sculpture in an upright position The top may include an elongated base to support at least a portion of the plurality of bristles extend 360 degrees about the top. The top may include a base having a substantially compressible outer region and a substantially non-compressible inner region. The top may include flared sections with channels between the flared sections. The flared sections and channels of the top may support a portion of the plurality of bristles in a convergent configuration so that the portion of the plurality of bristles is operable to receive and partially surround an object to be brushed. The channel may extend parallel and/or perpendicular to the handle. The method may further include the step of positioning a guard between the top and the handle. The guard may have a hand-abutment lower surface and a face-abutment upper surface.

Additional aspects, advantages, and utilities of the present invention will be set forth in part in the description which follows and, in part, will be obvious from the description, or may be learned by practice of the present invention.

BRIEF DESCRIPTION OF THE DRAWINGS

Embodiments of the present invention are described in detail below with reference to the attached drawing figures, wherein.

Figure 1:
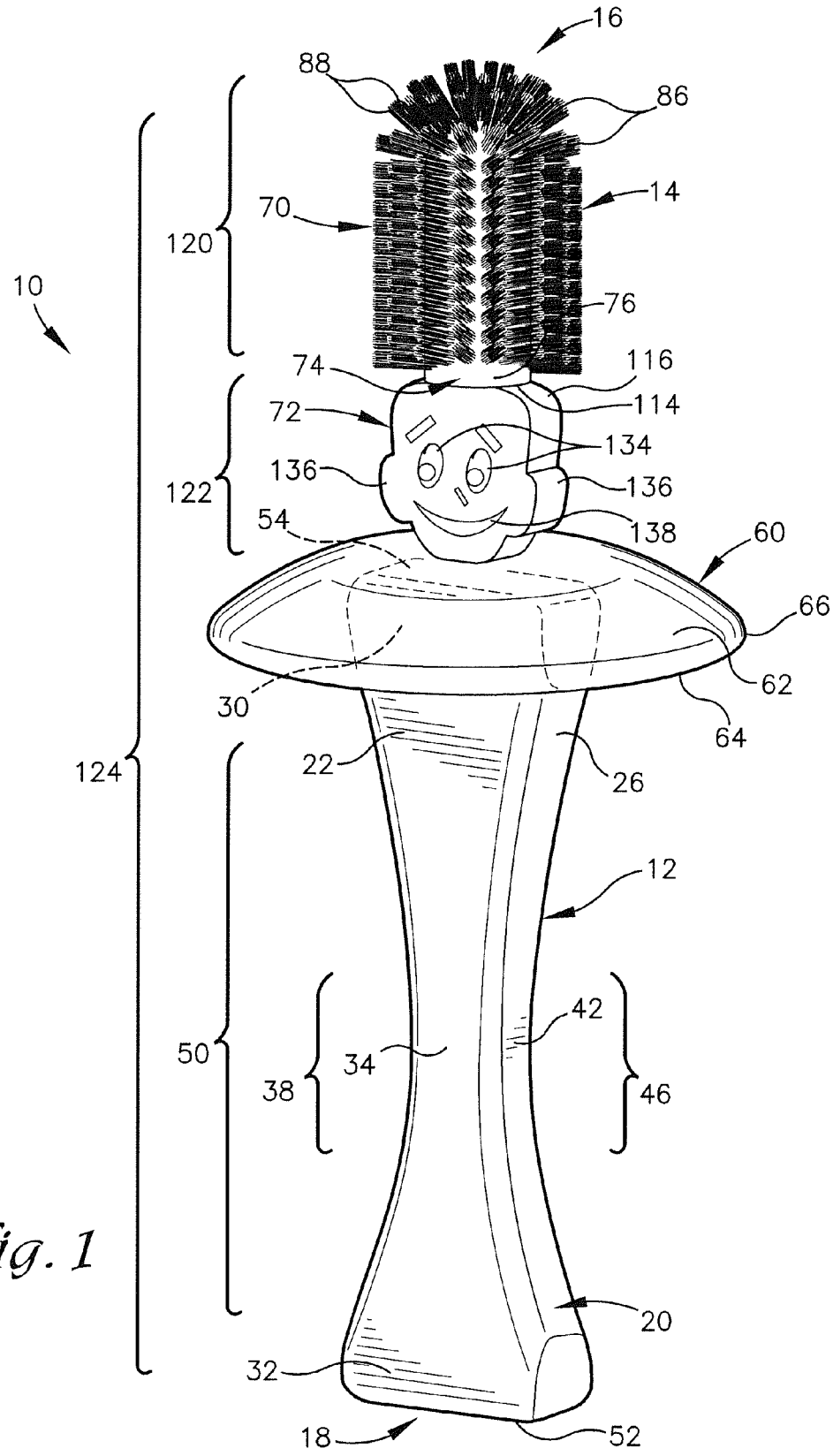
FIG. 1 is a front left side perspective view of an oral-care brushing implement, in accordance with an exemplary embodiment of the present invention, illustrating a hand guard secured between a top and a handle of the implement.
Figure 2:
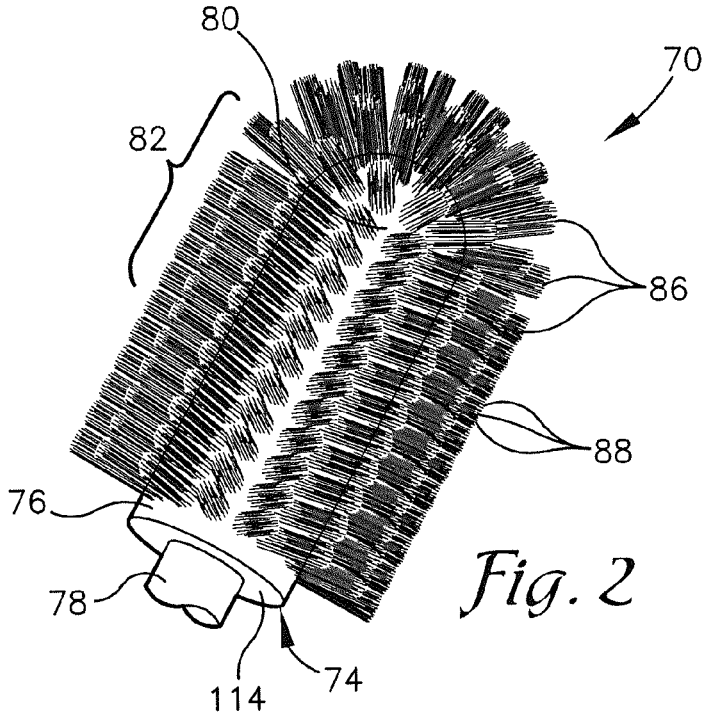
FIG. 2 is an enlarged perspective view of the top of the implement removed from the handle illustrated in FIG. 1.

The drawing figures do not limit the present invention to the specific embodiments disclosed and described herein. The drawings are not necessarily to scale, emphasis instead being placed upon clearly illustrating the principles of the present invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 4:
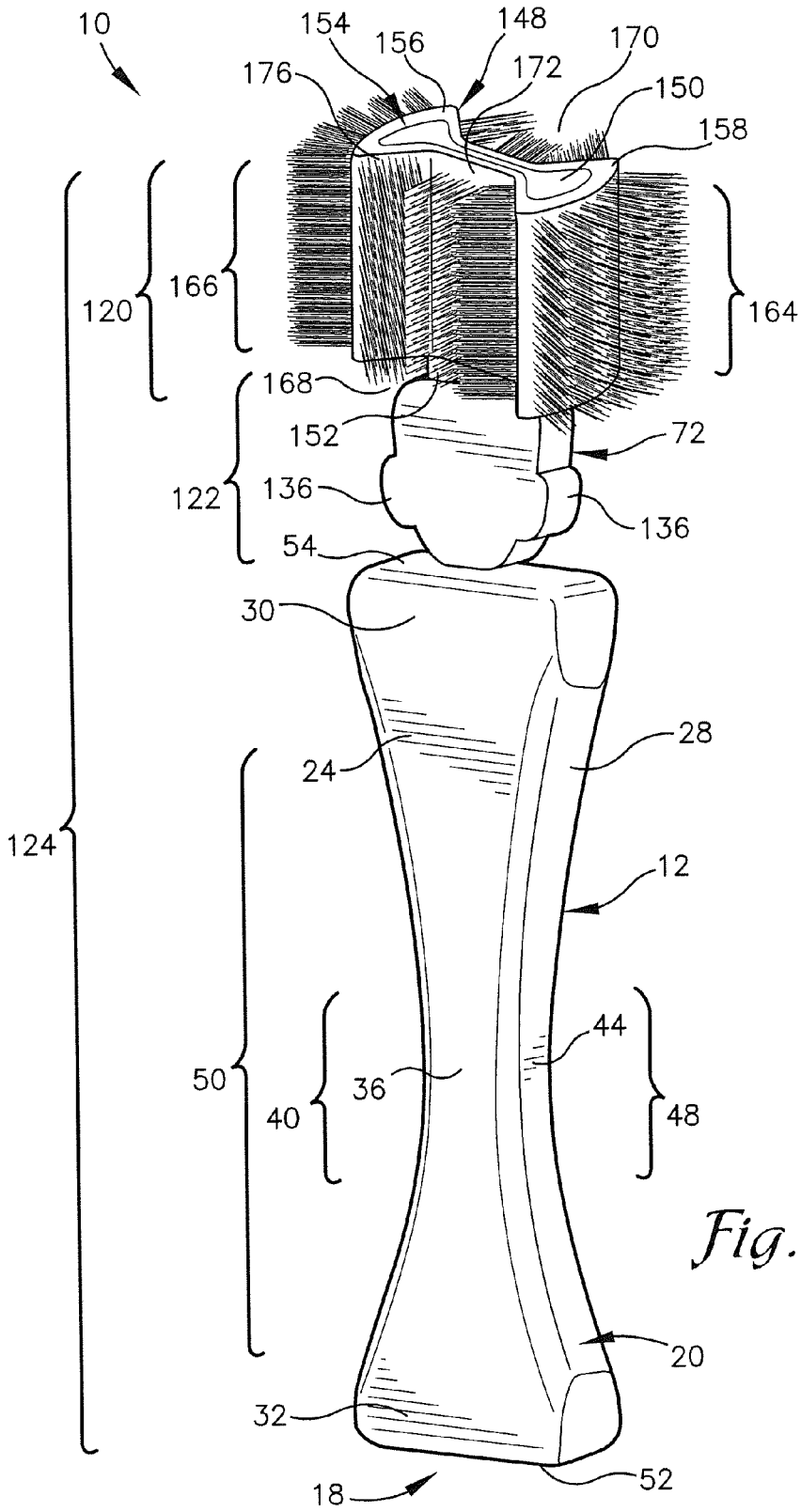
FIG. 4 is a rear right side perspective view of the oral-care brushing implement illustrated in FIG. 1, illustrating a second alternative top fitted to the handle of the implement.

Turning now to the drawing figures, and particularly FIG. 1, an oral-care brushing implement or toothbrush 10 is illustrated in accordance with an exemplary embodiment of the present invention. The toothbrush 10 generally includes an elongated handle 12 and a top or head assembly 14. The head assembly 14 is on a brushing end 16 of the toothbrush 10 and the handle 12 is on a gripping end 18 of the toothbrush 10. In the exemplary embodiment, the handle 12 is formed with a generally rectangular exterior 20 having opposing front and rear surfaces 22, 24, and opposing left-side and right-side surfaces 26, 28, as illustrated in FIGS. 1 and 4. The front and rear surfaces 22, 24 and left-side and right-side surfaces 26, 28 are respectively identical. It is foreseen, however, that the handle 12 could be formed to have other exterior shapes such as a cylindrical shape, an oval shape, or the like without deviating from the scope of the present invention.

The surfaces 22, 24, 26, 28 of the handle 12 are concave and form upper and lower flared ends 30, 32 on either end of the handle 12. Between the flared ends 30, 32 and along the respective front and rear surfaces 22, 24 are front and rear cavities 34, 36 with most-depressed regions 38, 40 substantially centered between the flared ends 30, 32. Between the flared ends 30, 32 and along the respective left-side and right-side surfaces 26, 28 are left and right cavities 42, 44 with most-depressed regions 46, 38 substantially centered between the flared ends 30, 32.

In the exemplary embodiment, the most-depressed regions 46, 48 of the left and right cavities 42, 44 are more depressed or extend inwardly with respect to the flared ends 30, 32 further than the most-depressed regions 38, 40 of the front and rear cavities 34, 36. It is foreseen, however, that the degree of depression or inward extension of any one or more of the cavities 34, 36, 42, 44 with respect to the flared ends 30, 32 could be equal and/or different with respect to each other, and/or eliminated altogether, e.g., to form a flat, even surface, without deviating from the scope of the present invention.

The handle 12 provides a secure gripping region 50 via the exterior 20 to facilitate gripping during handling of the toothbrush 10 by a user. Particularly, when the user grips the gripping region 50 of the handle 12 during use of the toothbrush 10, the flared ends 28, 30 and concavities 34, 36, 42, 44 cooperatively bias a hand of the user toward a center of the concavities 34, 36, 42, 44. In this manner, the gripping region 50 ensures a secure grip by the user and decreases the likelihood of the user dropping the toothbrush 10 or any slippage that may occur, for instance, if liquid is splashed onto the toothbrush 10 during use thereof.

The handle 12 may be oriented in an upright position by resting the toothbrush 10 on a bottom-end surface 52 of the handle 12. The bottom-end surface 52 defines an end of the lower-flared end 32 of the handle 12, which permits the bottom-end surface 52 to function as a stand when the toothbrush 10 is not in use, e.g., in storage. Opposite to and opposing the bottom-end surface 52 is a top-end surface 54. Similar to the bottom-end surface 52, the top-end surface 54 defines an end of the upper-flared end 30.

A circumferential hand guard 60 is secured to the top-end surface 54 and extends radially therefrom. The hand guard 60 has an upper surface 62, and a lower surface 64 with an annular edge 66 that defines an outermost perimeter of the upper and lower surfaces 62, 64. The hand hard 60 is concave and depends downwardly away from the top-end surface 54 and toward the bottom-end surface 52. In this manner, the hand guard 60 partially surrounds the upper-flared end 30 and the gripping surface 50. In the exemplary embodiment, the toothbrush 10 is permanently affixed with the hand guard 60, as illustrated in FIG. 1. It is foreseen, however, that the hand guard 60 could be selectively removable and/or omitted altogether from the toothbrush 10 without deviating from the scope of the present invention. The operation of the hand guard 60 in use will be discussed hereafter.

Extending from the handle 12 and secured thereto on the upper surface 62 side of the hand guard 60 is the head assembly 14, which includes a top 70 and a extension or connector 72 that secures the top 70 to the handle 12.

Figure 3:
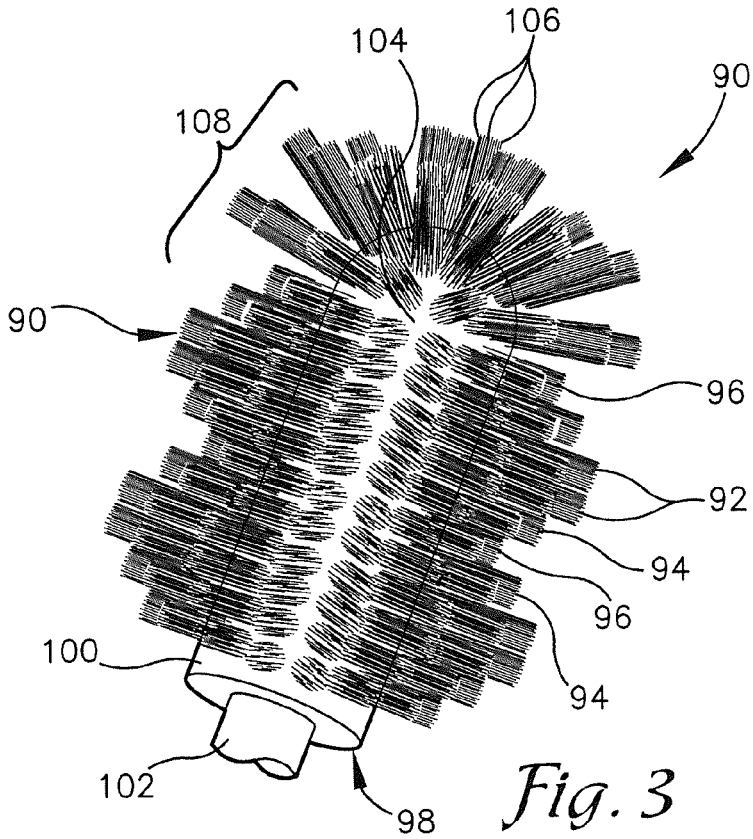
FIG. 3 is an enlarged perspective view of an alternative top of the implement removed from the handle illustrated in FIG. 1.

The top 70 includes an elongated base structure 74 having a cushion or outer buffer 76 that is substantially softer, chewable and compressible and is formed of a soft resilient chewable-type plastic, rubber, silicone, or other exotic or composite material. The outer buffer 76 defines an exterior surface of the base structure 74 with a shape that corresponds to a shape of the base structure 74. A core or inner-support rod 78 provides structural support to the outer buffer 76 and extends partially through and is substantially enveloped by the outer buffer 76. The inner-support rod 78 is substantially non-compressible relative to the outer buffer 76, and is formed of a hard synthetic or composite material such as, but not limited to a metal alloy, wood, rubber, plastic, or the like. The inner-support rod 78 defines a rounded dome 80 at an uppermost portion of the base structure 74. Secured to and radiating 360 degrees from the outer buffer 76 and the dome 80 are a plurality of tufts 86 that each include a grouping of bristles 88 of substantially equal lengths. In the exemplary embodiment, the tufts 86 are of substantially equal lengths to define a uniform outermost surface 82 of the top 70. The tufts 86 may be alternatively provided in various lengths, however, such as with alternative top 90, as illustrated in FIG. 3.

The top 90 may be utilized with the toothbrush 10 instead of the top 70 and includes a plurality of long, medium, and short tufts 92, 94, 96. Similar to the top 70, the top 90 includes an elongated base structure 98 having a cushion or outer buffer 100 that defines an exterior surface of the base structure 98 with a shape that corresponds to a shape of the base structure 98. The outer buffer 100 is preferably made of a material that is substantially compressible, such as those materials previously described with respect to the outer buffer 76.

An inner-support rod 102 provides structural support to the outer buffer 100 and extends partially through and is substantially enveloped by the outer buffer 100. The inner-support rod 102 is preferably made of a material that is substantially non-compressible, such as those materials previously described with respect to the inner-support rod 78. The outer buffer 100 defines a rounded dome 104 at an uppermost portion of the base structure 98. The tufts 92, 94, 96 each include groupings of bristles 106 that are substantially equal to each grouping and are secured to and radiate 360 degrees about the outer buffer 100 and the dome 104 of the head 90. The tufts 92, 94, 96 collectively define a plurality of non-uniform surfaces while the long tufts 92 define a uniform outermost surface 108 of the top 90.

The top 70 is secured to the connector 72 via the inner-support rod 78 that extends into the connector 72 so that a bottom surface 114 of the outer buffer 76 abuttingly engages a top surface 116 of the connector 72. The top 70, via its bristles 88, defines a brushing region 120 operable to extend into a mouth of the user and brush teeth and gums of the user during use of the toothbrush 10. The connector 72 defines a spacing intermediary region 122 between the brushing region 120 of the top 70 and the gripping region 50 of the handle 12.

The handle 12, the connector 72, and the top 70 have a pleasing ornamental region 124 extending therealong so that the toothbrush 10 substantially defines a three-dimensional sculpture that is shaped to resemble a character. In the exemplary embodiment, the character defined by the toothbrush 10 is a humanoid having an anatomical or humanoid shape. Particularly, the gripping region 50 of the handle 12 forms a lower portion or humanoid torso of the character. The upper-flared end 30 and the top-end surface 54 form humanoid shoulders, the most-depressed regions 38, 40, 46, 48 forming a humanoid waist, and the lower-flared end 32 and bottom-end surface or stand forming humanoid feet.

The hand guard 60 forms a collar, for instance, of a clothing garment or an extension of the humanoid shoulders, the connector 72 forms an upper portion or humanoid head of the character and the top 70 forms a hat or humanoid hair. To enhance the resemblance of the character to the humanoid, the head has humanoid facial features including eyes 134, ears 136, and a mouth 138. It is foreseen that the ornamental region 124 could be shaped to resemble characters other than humanoid characters without deviating from the scope of the present invention. For instance, the ornamental region 124 could be shaped to resemble an animal, a cartoon character, or the like.

Figure 5:
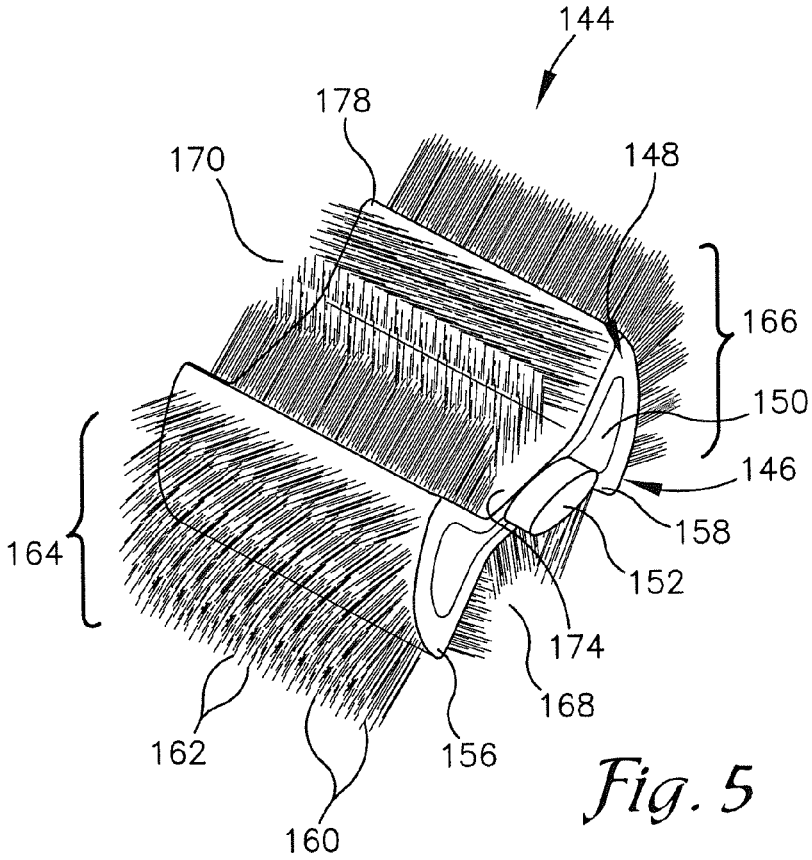
FIG. 5 is an enlarged perspective view of the second alternative top removed from the handle illustrated in FIG. 4.

In addition to the tops 70 and 90 with different tufts 86, 92, 94, 96, other tops with other head configurations may be fitted to the toothbrush 10 and utilized therewith. Such tops may be used based on a degree of dexterity and/or skill of the user, as may be indicated by an age of the user. For instance, the handle 12 and connector 72 may be utilized with a multi-surface top 144, as illustrated in FIGS. 4 and 5. Similar to the tops 70 and 90, the multi-surface top 144 includes an elongated base structure 146 having a cushion or outer buffer 148 that defines an exterior surface of the base structure 146 with a shape that corresponds to a shape of the base structure 146. The outer buffer 148 is preferably made of a material that is substantially softer, chewable and compressible such as those materials previously described with respect to the outer buffer 76.

An inner-support structure 150 with support rod 152 provides structural support to the outer buffer 148. The support rod 152 abuttingly engages the top surface 116 of the connector 72 and is permanently secured thereto via an adhesive. Alternately, the support rod 152 may be configured to partially be received into the connector 72 to permit selective attachment and removal of the top 144 to the connector 72. The support rod 152 extends partially through the inner-support structure 150 and the outer buffer 148 and is substantially enveloped by the inner-support structure 150 and the outer buffer 148. The inner-support structure 150 and support rod 152 may be made of the same or different materials, but are preferably made of a material that is substantially non-compressible, such as those materials previously described with respect to the inner-support rod 78.

The outer buffer 148, the inner-support structure 150, and the support rod 152 cooperatively define a top surface 154 at an uppermost portion of the base structure 146. The outer buffer 148 and the inner-support structure 150 cooperatively define lateral flared sections 156, 158 at outermost portions of the base structure 146. Tufts 160 are secured to and extend from the outer buffer 148 and each include groupings of bristles 162. A portion of the tufts 160 with bristles 162 define uniform outermost surfaces 164, 166 of the respective lateral flared sections 156, 158. Another portion of the tufts 160 with bristles 162 define concavities or channels 168, 170 between the lateral flared sections 156, 158. Each of the channels 168, 170 have depressed surfaces 172, 174 with respective side surfaces 176, 178. The tufts 160 defining the channels 168, 170 are secured to and extend from the surfaces 172, 174, 176, 178 in convergent directions. The tufts 160 extend 360 degrees, that is, entirely about the multi-surface top 144.

Figure 6:
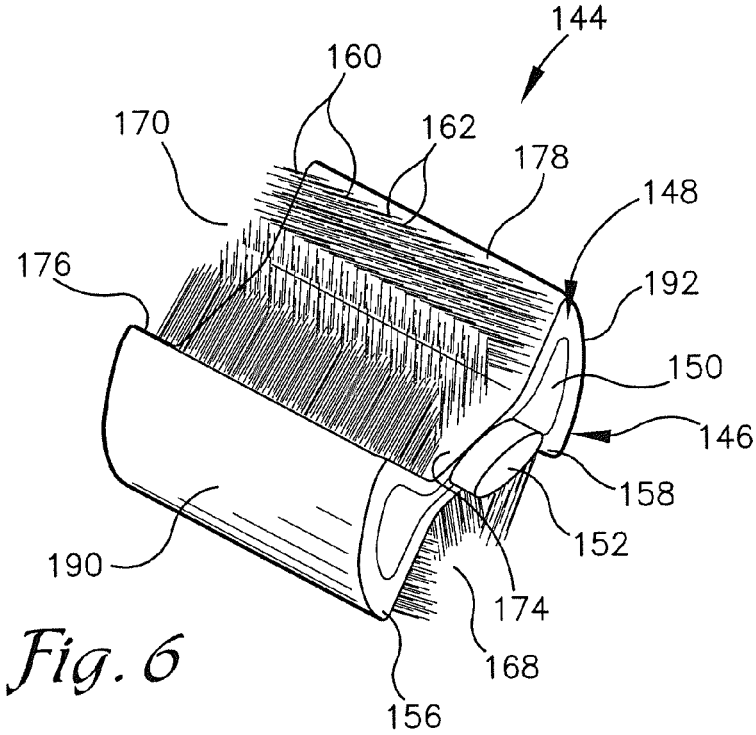
FIG. 6 is an enlarged perspective view of a third alternative top removed from the handle of the implement.

In the exemplary embodiment, the channels 168, 170 run parallel to the handle 12. It is foreseen, however, that the rod 152 could be positioned and the multi-surface top 144 could be rotated and/or attached to the connector 72 in any manner, for instance, with the channels 168, 170 running perpendicular to the handle 12, without deviating from the scope of the present invention. Additionally, it is foreseen that tufts with bristles could be secured to the top surface 154 and/or tufts with bristles of the same and/or varying lengths, rigidity, softness, and/or bristle and/or tuft densities could be used and/or omitted from on any one or more of the surfaces 154, 172, 174, 176, 178 without deviating from the scope of the present invention. For instance, FIG. 6 illustrates the multi-surface top 144 having the tufts 160 with bristles 162 removed from the outermost convex surfaces 190, 192 of the flared sections 156, 158, and are only present on the depressed surfaces 172, 174 and respective side surfaces 176, 178 of the channels 168, 170. In this manner, the outermost convex surfaces 190, 192 are bare, thus exposing a portion of the outer buffer 148, which is softer and may be chewed or compressed without wearing down or damaging any of the tufts 160 with bristles 162 and shortening the lifespan of the multi-surface top 144.

Figure 7:
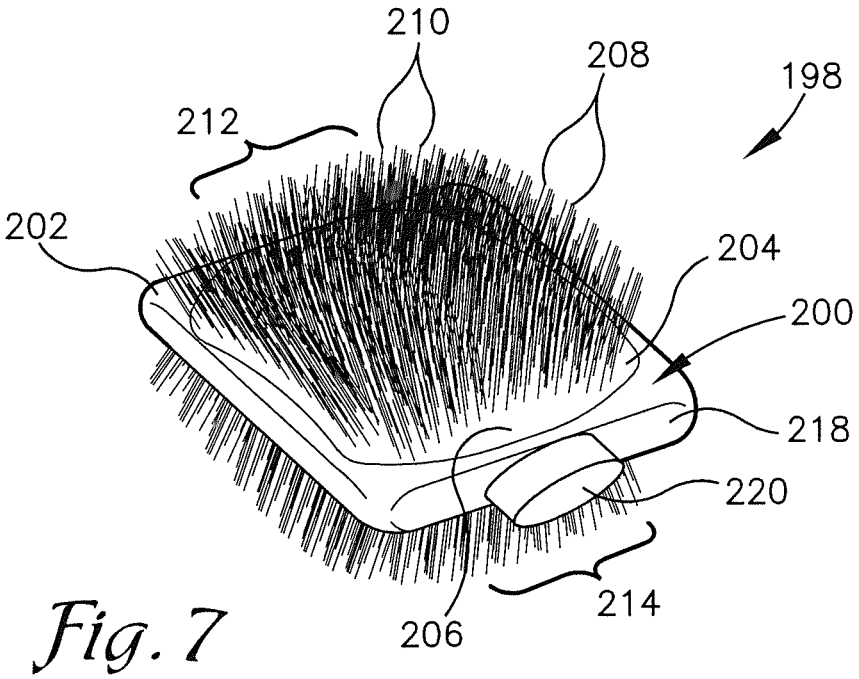
FIG. 7 is an enlarged perspective view of a fourth alternative top removed from the handle of the implement.

In addition to the tops 70, 90, 144, a dual-sided convex top 198, as illustrated in FIG. 7, may be fitted to the toothbrush 10 and utilized therewith. Similar to the tops 70, 90, 144, the dual-sided convex top 198 includes a base structure 200 that defines an outer perimeter 202 of the top 198 and surrounds an interior cushion 204. The base structure 200 provides structural support to the interior cushion 204 is preferably made of a material that is substantially non-compressible, such as those materials previously described with respect to the inner-support rod 78. The interior cushion 204 has convex surfaces 206 on either side of the top 198 that support tufts 208 with bristles 210 mounted thereto. The interior cushion 204 is preferably made of a material that is substantially softer, chewable and compressible such as those materials previously described with respect to the outer buffer 76.

Extending from a bottom end 218 of the base structure 200 is a support rod 220 that is configured to abuttingly engage the top surface 116 of the connector 72 and may be permanently secured thereto via an adhesive. Alternatively, the support rod 220 may be configured to partially be received into the connector 72 to permit selective attachment and removal of the top 144 and the connector 72, or the connector 72 may be omitted altogether and the top 144 may be permanently or removable secured directly to the top-end surface 54 of the handle 12. The support rod 220 may be made of a material that is the same as or different than that of the base structure 200, and is preferably made of a material that is substantially non-compressible, such as those materials previously described with respect to the inner-support rod 78.

The toothbrush 10 is used to brush the teeth and gums of the user by the user or another helping the user. Irrespective of tops 70, 90, 144, 198, the brushing operation performed using the toothbrush 10 is substantially the same. When the user desires to perform the brushing operation, the user may convert the toothbrush 10 from its upright-stored position, as oriented by the bottom-end surface 52 or stand, to a substantially horizontal-use position. Such is preferably accomplished by gripping the toothbrush 10 by the gripping region 50 of the handle 12, which is used throughout use of the toothbrush 10. The user then inserts the brushing end 16 into the mouth of the user so that the bristles 88 contact the gums and teeth of the user, at which point the bristles 88 may be jogged therealong to perform the brushing operation and remove any foreign debris such as plaque.

The intermediary region 122 is of a sufficient length to allow the bristles 88 to be extended into the mouth of the user while the user manipulates the bristles 88 via the gripping region 50 of the handle 12. The mouth guard 60 provides dual protection to the user and facilitates proper use of the toothbrush 10. Particularly, the lower surface 64 of the mouth guard 60 provides an abutment surface for the hand of the user and is operable to prevent the hand from entering the mouth, which could result in biting of the hand and/or contamination of the mouth of the user. The upper surface 62 of the mouth guard 60 provides an abutment surface for the face of the user and is operable to prevent the toothbrush 10 from extending too far into the mouth of the user, which could result in choking.

If the user bites down on the bristles 88, the outer buffer 76 absorbs force of the bite to prevent damage to the teeth and/or gums of the user. If the force of the bite is not excessive, the outer buffer 76 safely facilitates continued use of the toothbrush 10 with a heightened degree of effectiveness. Particularly, if the user partially bites down on the toothbrush 10, the outer buffer 76 allows the bristles 88 to compress slightly while maintaining operability, and the 360 degree configuration of the bristles 88 results in brushing of both the upper and lower teeth of the user.

The tops 70, 90, 144, 198 and tufts 86, 90, 92, 94, 160, 208 thereof are operable to contact various portions of the teeth and gums of the user. For instance, the tops 70, 90 with tufts 86, 90, 92, 94 have relatively smaller outermost surfaces 82, 108, which are ideal for use by a more experienced or older user having a heightened degree of dexterity and/or skill. Particularly, the outermost surfaces 82, 108 permit the older user to use the toothbrush 10 and brush specific teeth and/or gums in a more meticulous manner with a heightened degree of precision.

The top 144 with tufts 160 has relatively larger, more expansive outermost surfaces 164, 166, and is ideal for use with a novice or younger user having a lesser degree of dexterity and/or skill. Particularly, the channels 168, 170 are effective to receive a plurality of teeth therein while substantially surrounding the teeth with the tufts 160. In this manner, the tufts 160 may effectively brush the surrounded teeth while stimulating adjacent gum in one or more strokes of the toothbrush 10, thereby facilitating effective use of the toothbrush 10 while consuming less time.

The top 198 with tufts 208 has expansive, uniform convex outermost surfaces 212, 214 that correspond to the shape of the convex surfaces 206 on either side of the top 198. The softness or compressibility of the interior cushion 204 allows the bristles 210 to compress during use of the top 198. Because the outermost surfaces 212, 214 are more expansive than other tops 70, 90, 144, the surfaces 212, 214 provide a greater degree of compression and flexibility relative to less-expansive tops 70, 90, 144. In this manner, the tufts 208 with bristles 210 of the top 198 more easily conform to a surface area to be brushed, e.g., contours of and between teeth and gums thereby more effectively brushing the surface area.

The ornamental region 124 increases the user's desire to use the toothbrush 10, which is especially effective for a younger user. For instance, if the ornamental region 124 resembles a favorite character and/or a recognizable character of the younger user, the toothbrush 10 will be particularly pleasing to the younger user, thereby increasing the likelihood that the younger user will desire interaction with and otherwise enjoy use of the toothbrush 10. Particularly, the humanoid head of the character formed by the connector 72, as in the exemplary embodiment, is positioned to disappear into and reappear from the mouth of the user during use thereof. The humanoid hair of the character formed by the top 70 permits the user to brush his teeth and gums with the humanoid hair of the character all while manipulating the toothbrush 10 via the humanoid torso of the toothbrush 10.

In this manner, the present invention provides an oral-care brushing implement that provides effective, efficient, and safe use by a user with impaired dexterity and/or skill, and incentivizes use by the user. Although the present invention has been described with reference to the preferred embodiment illustrated in the attached drawing figures, it is noted that equivalents may be employed and substitutions made herein without departing from the scope of the present invention as recited in the claims.

Having thus described the preferred embodiment of the present invention, what is claimed as new and desired to be protected by Letters Patent includes the following:

1. An oral-care brushing implement comprising:

a handle having a gripping region;

a head assembly secured at an end of the handle, the head assembly having an intermediary region and a brushing region;

an ornamental region comprising the handle and the intermediary region, the ornamental region defining a three-dimensional sculpture, wherein the three-dimensional sculpture is shaped to resemble a character, wherein the character has an anatomical shape with a torso defining a gripping region, the outermost portion of the three-dimensional sculpture defining the brushing region, and the intermediary region spacing the gripping region and the brushing region; and a plurality of bristles radiating from a top of the head assembly to define a portion of the three-dimensional sculpture.

2. The implement as set forth in claim 1, wherein the torso includes shoulders on an end of the torso adjacent to the intermediary region and a stand on another end of the torso opposite to the shoulders, the stand operable to support the three-dimensional sculpture in an upright position.

3. The implement as set forth in claim 1, wherein the portion of the three-dimensional sculpture defined by the plurality of bristles is an outermost surface of an uppermost portion of the three-dimensional sculpture.

4. The implement as set forth in claim 1, wherein the handle defines an outermost surface of a lowermost portion of the three-dimensional sculpture.

5. The implement as set forth in claim 1, wherein the handle has a flared top end and a flared bottom end with a concave region between the flared ends to facilitate gripping of the gripping region portion of the handle.

6. The implement as set forth in claim 1, wherein the plurality of bristles are of varying lengths with a longest of the plurality of bristles defining a uniform outermost surface of the head assembly.

7. The implement as set forth in claim 1, wherein the head assembly includes an elongated base to support at least a portion of the plurality of bristles in a 360 degree configuration, the elongated base extending parallel to the handle.

8. The implement as set forth in claim 1, wherein the brushing region includes a base having a substantially compressible outer region and a substantially non-compressible inner region.

9. The implement as set forth in claim 1, wherein the brushing region includes a base having flared sections with concavities between the flared sections, the flared sections and concavities of the base supporting the portion of the plurality of bristles in a convergent configuration to define a channel operable to receive and partially surround an object to be brushed, the channel extending parallel or perpendicular to the base.

10. The implement as set forth in claim 9, wherein the flared sections oppose and face away from each other and the concavities oppose and face away from each other.

11. The implement as set forth in claim 10, wherein at least a portion of each flared section is convex and at least some of the plurality of bristles radiate from the flared sections.

12. The implement as set forth in claim 1, further comprising:

a guard between the head assembly and the handle, the guard having a hand-abutment lower surface and a face-abutment upper surface.

13. The implement as set forth in claim 12, wherein the face-abutment upper surface is convex so that the upper surface forms a dome shape.

14. The implement as set forth in claim 1, wherein the brushing region includes a cylindrical shaft and a rounded tip, and the bristles radiate from the shaft and the tip.

15. The implement as set forth in claim 1, wherein the brushing region includes two convex surfaces opposite each other and the bristles radiate from the two surfaces.

16. An oral-care brushing implement having an ornamental outer surface that resembles a character, the implement comprising:

a handle having a gripping region comprising a flared bottom portion, a flared top portion, and a narrow central portion including front, rear, left, and right cavities for biasing a hand of a user towards the central portion, the left and right cavities depressing farther than the front and back cavities with respect to the flared portions, the flared bottom portion having a flat bottom for balancing the implement thereon, and the handle having rounded edges and rounded corners;

a head assembly including an extension and a top, the head assembly secured at an end of the handle;

an ornamental region comprising the handle and the extension, the ornamental region defining a three-dimensional sculpture, wherein the handle is shaped to resemble a torso and the extension is shaped to resemble a head, the extension having a substantially uniform thickness, and at least one facial feature suggesting a positive mood, for enticing a child to use the implement;

a plurality of tufts each including a plurality of bristles of varying lengths; and a guard secured between the handle and the head assembly to partially enclose the handle, the hand guard having a hand-abutment lower surface and a face-abutment upper surface, wherein the face-abutment upper surface is convex so that the upper surface forms a dome shape, wherein the guard is between the head-shaped extension and the torso-shaped handle, wherein, the extension spaces the top from the handle, and the top includes (i) a support rod secured at an end of the extension and (ii) a circumferential cushion mounted to the support rod, wherein the support rod and the circumferential cushion form a cylindrical portion and the top further includes a rounded tip, the plurality of tufts extending from the cylindrical portion in a circumferential configuration and extending from the tip in a partial spherical configuration.

* * * * *